US008134507B2

(12) United States Patent
Chen et al.

(10) Patent No.: US 8,134,507 B2
(45) Date of Patent: Mar. 13, 2012

(54) MOBILE ELECTRONIC DEVICE

(75) Inventors: Kuo-Cheng Chen, Taoyuan County (TW); Jen-Chen Lu, Taoyuan County (TW); Huan-Chu Huang, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 410 days.

(21) Appl. No.: 12/436,102

(22) Filed: May 5, 2009

(65) Prior Publication Data

US 2010/0141535 A1 Jun. 10, 2010

(30) Foreign Application Priority Data

Dec. 5, 2008 (TW) ..... 97147403 A

(51) Int. Cl.
*H01Q 1/24* (2006.01)

(52) U.S. Cl. ..... 343/702
(58) Field of Classification Search ..... 343/702
See application file for complete search history.

(56) References Cited

U.S. PATENT DOCUMENTS

2008/0150815 A1* 6/2008 Nakahata et al. ..... 343/718
2008/0182539 A1* 7/2008 Hata et al. ..... 455/269
2009/0174612 A1* 7/2009 Ayala et al. ..... 343/702

* cited by examiner

*Primary Examiner* — Tho G Phan
(74) *Attorney, Agent, or Firm* — Jianq Chyun IP Office

(57) ABSTRACT

A mobile electronic device including an appearance, a first antenna and a metal part is provided. The appearance is used to accommodate a substrate. The first antenna is disposed on the substrate, and the metal part is disposed on an external surface of the appearance. During overall operation, the mobile electronic device receives or transmits signals through a first bandwidth radio frequency band by the first antenna and the metal part.

14 Claims, 4 Drawing Sheets

| Distance D21 | 1.8cm | 2.3cm | 2.8cm | 3.3cm | 3.8cm |
|---|---|---|---|---|---|
| Average gain of antenna 130 | −7.0 dBi | −6.5 dBi | −5.5 dBi | −6.3 dBi | −6.9 dBi |

FIG. 4

MOBILE ELECTRONIC DEVICE

CROSS-REFERENCE TO RELATED APPLICATION

This application claims the priority benefit of Taiwan application serial No. 97147403, filed on Dec. 5, 2008. The entirety of the above-mentioned patent application is hereby incorporated by reference herein and made a part of this specification.

BACKGROUND OF THE INVENTION

1. Field of the Invention

The present invention relates to a mobile electronic device, especially to a mobile electronic device using coupling between a metal part and an antenna to enhance reception of the antenna.

2. Description of Related Art

Currently, telecommunication methods of the public have entered the age of wireless communication, so mobile electronic devices are used more and more often in different sorts of occasions and are more and more diverse, for example cell phones, smart phones, multimedia players, personal digital assistants and satellite positioning devices and so on. Different sorts of small mobile electronic devices have been gradually developed, and have become necessary electronic products in the daily lives of people.

In transmission mechanisms of wireless communication, an early mobile electronic device receives electromagnetic signals through a single antenna, and then transmits the signals received by the antenna to an internal circuit, so as to perform a series of processing on the signal received by the antenna. As hardware equipment and technology of wireless communication advances, current wireless communication systems mostly adopt methods of multiple antennas operating simultaneously, so as to enhance characteristics such as reliability, transmission speeds and reception ranges of the systems through mechanisms of multiple path transmission.

However, no matter operation modes of a single antenna or multiple antennas operating simultaneously, a certain hardware space is required for the mobile electronic device to accommodate the antenna in order to achieve a purpose of wireless transmission. Therefore, how to consider the hardware space of the mobile electronic device under circumstances of enhancing transmission mechanisms of wireless communication is a great issue faced in development of the mobile electronic devices.

SUMMARY OF THE INVENTION

The present invention provides a mobile electronic device which uses a metal part disposed on an external surface of an appearance to enhance reception of an antenna disposed in the appearance and is beneficial to an exterior design of the mobile electronic device.

The present invention provides a mobile electronic device which includes an appearance, a first antenna and a metal part. The appearance is used to accommodate a substrate. The first antenna is disposed on the substrate, and the metal part is disposed on the external surface of the appearance. During overall operation, the mobile electronic device receives or transmits signals through a first bandwidth radio frequency band by the first antenna and the metal part.

According to an embodiment of the present invention, the above mobile electronic device further includes a second antenna. The second antenna is disposed on the substrate. The mobile electronic device receives or transmits signals through a second bandwidth radio frequency band by the second antenna and the metal part.

According to an embodiment of the present invention, the first antenna is used for receiving or transmitting signals through the first bandwidth radio frequency band, the second antenna is used for receiving or transmitting signals through the second bandwidth radio frequency band, and the metal part is used for receiving or transmitting signals through the first bandwidth radio frequency band and second bandwidth radio frequency band.

According to an embodiment of the present invention, distances between geometric centers of projections of the above first antenna and the second antenna on the external surface of the appearance and a geometric center of the metal part are respectively maintained within a predetermined range.

According to an embodiment of the present invention, the above first antenna and the second antenna are respectively disposed on a first corner and a second corner of the substrate. In addition, the first corner and the second corner are adjacent to each other.

As described above, the present invention uses the metal part disposed on the external surface of the appearance to enhance patterns and average gains of the antennas disposed inside the appearance. Hence, under the influence of the metal part, the antenna has better reception. Additionally, the metal part disposed on the external surface of the appearance may adopt different textures and colors to beautify the exterior design of the mobile electronic device, and necessary text patterns of corporate trademarks may be further printed thereon. In other words, the metal part of the present invention enhances reception of the antennas and enhances the exterior design of the mobile electronic device using the established hardware space in the mobile electronic device.

In order to make the aforementioned and other objects, features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 4 is a comparison table showing average gains relative to distances D21 of the antenna 130.

DESCRIPTION OF EMBODIMENTS

Figure 1:
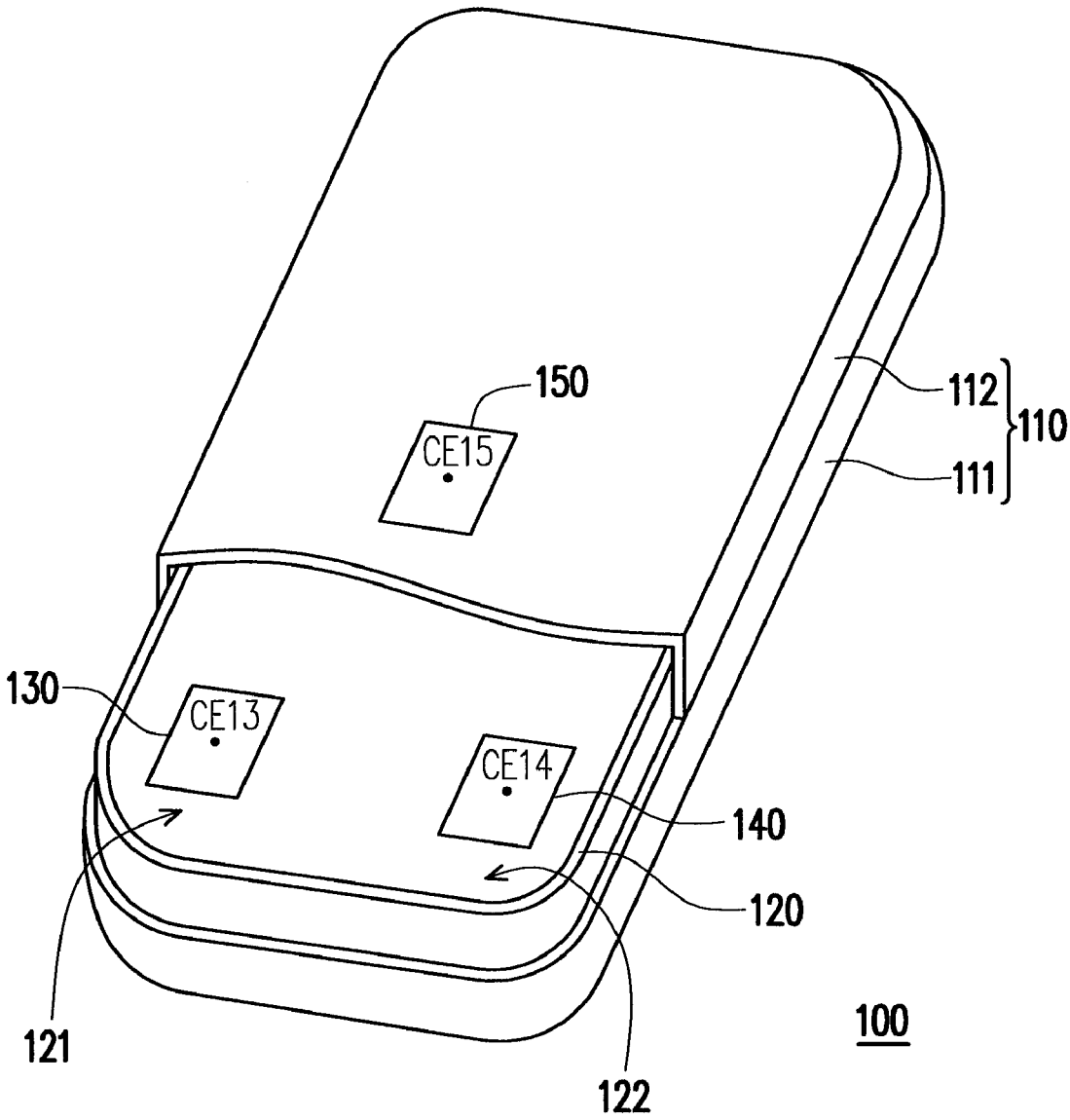
FIG. 1 is a schematic diagram showing a structure of a mobile electronic device according to an embodiment of the present invention.

FIG. 1 is a schematic diagram showing a structure of a mobile electronic device according to an embodiment of the present invention. Referring to FIG. 1, a mobile electronic device 100 includes an appearance 110, a substrate 120, an antenna 130, an antenna 140 and a metal part 150. The mobile electronic device 100 is, for example, a personal digital assistant phone, a smart phone, a satellite positioning device or a personal digital assistant, and the substrate 120 is, for example, a printed circuit board. A possible form of embodiment of the appearance indicated herein includes a housing of the mobile phone or a part of the housing of the mobile phone (for example a back cover of the mobile phone or a back cover of a battery), a part of a surface of the battery or a part of an additional component disposed on the housing of the mobile phone.

Still referring to FIG. 1, the appearance 110 includes an upper housing 111 and a lower housing 112. The upper housing 111 and the lower housing 112 are stacked with each other to form a chamber, and the substrate 120 is disposed in the chamber of the housing 110. In further detail, the antenna 130 and the antenna 140 are disposed on the substrate 120, and the metal part 150 is disposed on an external surface of the appearance 110. Generally speaking, the metal part 150 may be considered as an additional extending part of main bodies of the antennas, having effects of improving reception of the antennas.

It should be noted that, the relative positions between the antenna 130, the antenna 140 and the metal part 150 have specific relative positions. Technically, the metal part 150 communicates with the antenna 130 and the antenna 140 disposed in the appearance 110 over the coupling effect, so that no additional circuit designs (for example wire bonding technology, electrical connections and contact points) are required. However, the metal part 150 and radiation bodies of the antenna (130,140) must have at least a part of projection areas overlapped in a direction perpendicular to the substrate, so as to enhance reception, but they can not be overlapped too much, or reception paths will be obstructed.

The present invention uses respective geometric centers of the main bodies of the antennas and of the metal part as an analytic basis, so that the so-called meaning of the metal part being required to have a certain part that overlaps with the radiation bodies of the antennas is further illustrated. This is because illustration only using a size of the overlapping part between two (for example an antenna and a metal part) is kind of indefinite, but analysis performed using the geometric centers of the two would be clearer. Also, in order to illustrate conveniently, the present invention particularly labels relative positions of the two antennas and at least one metal part. However, in actual practice, only one antenna and one metal part are enough.

Figure 2:
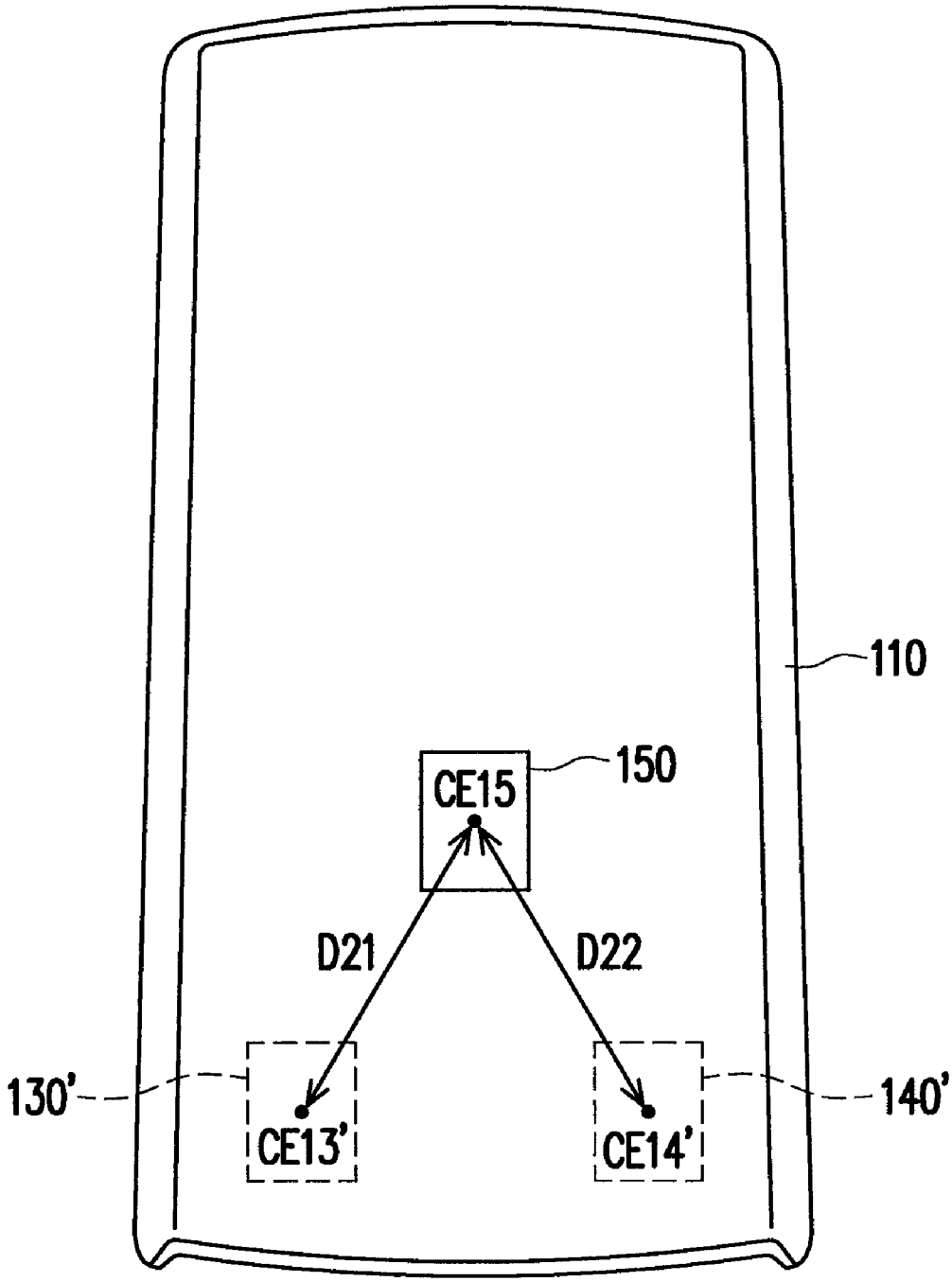
FIG. 2 is a top view showing an appearance 110.

For example, FIG. 2 is a top view showing the appearance 110. As shown in FIG. 2, the metal part 150 is disposed on the appearance 110. Additionally, if viewed from a perspective angle, the reference numerals 130' and 140' respectively represent the antenna 130 and the antenna 140 projected on the external surface of the appearance 110. On the other hand, the reference numerals CE13' and CE14' respectively represent the relative positions of the geometric centers CE13 and CE14 when the antenna 130 and the antenna 140 are projected on the external surface of the appearance 110.

It should be noted that, according to the present embodiment, the antenna 130 and the antenna 140 are projected on the external surface of the appearance 110 along the direction perpendicular to the substrate 120. Hence, regarding the projection mechanisms from another point of view, the geometric center CE13 of the antenna 130 extends as a first virtual line along the direction perpendicular to the substrate 120, and an intersection of the first virtual line and the external surface of the appearance 110 is the geometric center CE13' of the antenna 130 projected on the external surface of the appearance 110. Relatively, the geometric center CE14 of the antenna 140 extends as a second virtual line along the direction perpendicular to the substrate 120, and an intersection of the second virtual line and the external surface of the appearance 110 is the geometric center CE14' of the antenna 140 projected on the external surface of the appearance 110.

In addition, the respective geometric centers of the antenna 130, the antenna 140 and the metal part 150 changes as various shapes of the antenna 130, the antenna 140 and the metal part 150. For example, when the shape of the metal part 150 is a triangle, the geometric center of the metal part is a gravity center of the triangle. Therefore, when the shape of the metal part 150 is a circle, the geometric center of the metal part 150 is the center of the circle. Although the present embodiment exemplifies the shapes of the metal part 150, they are not used to limit the present invention. Persons having ordinary skills in the art may change the shape of the metal part 150 to a rectangle or to other irregular geometric shapes according to design requirements.

At the same time, marked positions of the antennas 130 and the antenna 140 in FIGS. 1 and 2 do not represent real design shapes of the radiating bodies of the antennas and are only used as examples to show positions of the geometric centers of the antennas. The shape of the metal part is illustrated as above, and it may also be relatively adjusted according to the design requirement. Here it is more convenient to illustrate using the respective positions of the geometric centers. Of course, the relative distances and positions between each of the geometric centers in FIGS. 1 and 2 are illustrated more exaggeratedly, so as to facilitate convenience of analysis and illustration.

Still referring to FIG. 2, when takes the external surface of the appearance 110 as a basis, a distance D21 formed between the geometric center CE13' of the antenna 130 projected on the external surface of the appearance 110 and the geometric center CE15 of the metal part 150 is maintained in a predetermined range, meaning that the metal part 150 and the radiation body of the established antenna 130 must have at least a part of projection areas are overlapped in the projection direction perpendicular to the substrate 120. On the other hand, a distance D22 formed between the geometric center CE14' of the antenna projected on the external surface of the appearance 110 and the geometric center CE15 of the metal part 150 is maintained in another predetermined range. An embodiment thereof is similar to a method of the above antenna 130 corresponding to the metal part 150. The antenna 140 and the metal part 150 must have at least a part of projection areas are overlapped.

The so-called predetermined range, which is the relative distances between the respective geometric centers of the antennas and the metal part, changes according to different structure designs (for example PIFA, loop, monopole, dipole) of the antennas. In the present invention, the antenna 130 and the antenna 140 may be considered as having a same design structure, but the present invention is not limited to this. Persons having ordinary skills in the art may arbitrarily adjust the structure of the antennas according to design requirements. In other words, dispositions of the antenna 130, the antenna 140 and the metal part 150 maintain an equal relation of the distance D21 and the distance D22 being within the predetermined ranges.

Therefore, persons having ordinary skills in the art may arbitrarily adjust the relative positions of the antenna 130, the antenna 140 and the metal part 150 under the condition of the antenna 130, the antenna 140 and the metal part 150 maintain equal relations, which is a condition in that the distance D21 and the distance D22 are both within the predetermined ranges. For example, according to the present embodiment, the antenna 130 is disposed at a corner part 121 of the substrate 120, and the antenna 140 is disposed at a corner part 122 of the substrate 120, wherein the corner part 121 and the corner part 122 are adjacent to each other.

Still referring to FIG. 1, in overall operation, the mobile electronic device 100 receives or transmits signals through a first bandwidth radio frequency band and a second bandwidth radio frequency band by the antenna 130, the antenna 140 and the metal part 150. It should be noted that, the antenna 130 is used for receiving or transmitting signals through the first bandwidth radio frequency band, the antenna 140 is used for receiving or transmitting signals through the second bandwidth radio frequency band, and the metal part 150 is used for receiving or transmitting signals through the first bandwidth radio frequency band and second bandwidth radio frequency band.

In other words, the antenna 130 and the antenna 140 are used for receiving and transmitting signals within a bandwidth range, for example receiving and transmitting communication signals (2G, 2.5G, 2.75G, 3G and over 3G), GPS signals, Bluetooth signals, WiFi signals or WiMAX signals. The metal part 150 is used to cooperate with different operating bandwidths of the antenna 130 and the antenna 140, so as to receive and transmit multi-band signals with multi-band ranges. Due to the condition of the antenna 130, the antenna 140 and the metal part 150 maintaining equal relations in disposition, the metal part 150 respectively generates coupling effects with the antenna 130 and the antenna 140, thereby improving the patterns and average gains of the antenna 130 and the antenna 140.

Figure 3A:
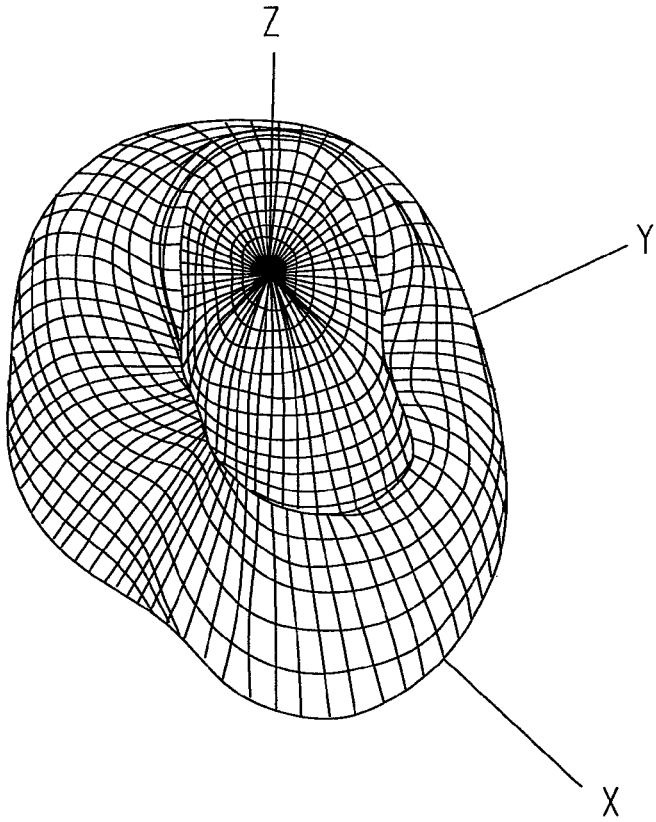
FIG. 3A is a schematic diagram showing a pattern of an antenna 130 when a metal part 150 is not disposed.
Figure 3B:
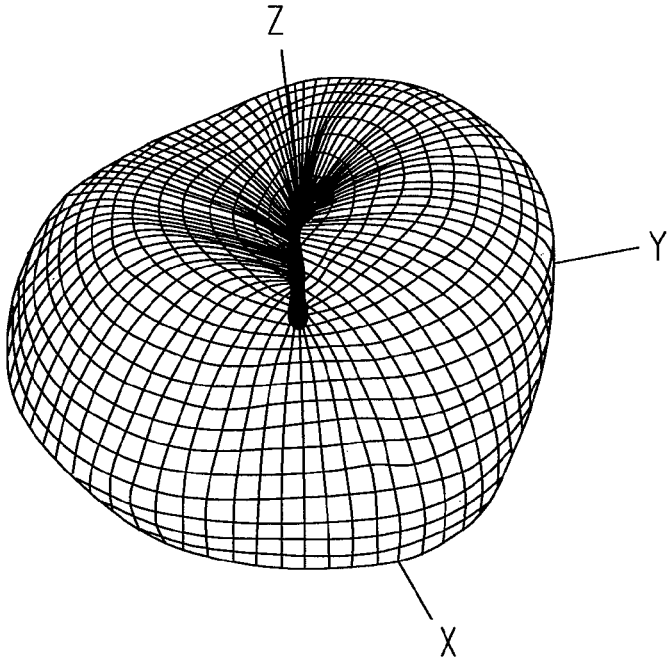
FIG. 3B is a schematic diagram showing a pattern of an antenna 130 when a metal part 150 is disposed.

For example, FIG. 3A is a schematic diagram showing a pattern of the antenna 130 when the metal part 150 is not disposed, and FIG. 3B is a schematic diagram showing a pattern of the antenna 130 when the metal part 150 is disposed. Referring to both FIGS. 3A and 3B, it is obviously observable that when the metal part 150 is disposed on the mobile electronic device 100, the pattern of the antenna 130 is more uniform so that the antenna 130 has better reception. On the other hand, FIG. 4 is a comparison table showing the average gains relative to the distance D21 of the antenna 140. Referring to FIG. 4, it is obviously observable that if the distance D21 of the metal part 150 corresponding to the antenna 130 is maintained within the predetermined range, the metal part 150 has an effect of improvement on reception of the mobile electronic device 100, and by adjusting the distance D21, the effect on the average gain of the antenna 130 by the metal part 150 is adjusted. Here, as shown in FIG. 4, when the distance D21 of the metal part 150 corresponding to the antenna 130 is maintained at 2.8 cm, the antenna 130 has the best average gain (−5.5 dBi).

In summary, the present invention uses the metal part disposed on the external surface of the appearance to generate the coupling effect with the antenna disposed in the appearance. Hence, under influence of the metal part, the antennas have the better patterns and average gains, thereby increasing their reception. In addition, corporation names or any product trademarks may be printed on the metal part on the surface of the appearance, or different textures and color may be used to beautify the exterior design of the mobile electronic device, thereby increasing attraction to consumers. In other words, the metal part of the present invention enhances reception of the antennas and enhances the exterior design of the mobile electronic device in the established hardware space in the mobile electronic device.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A mobile electronic device, comprising:

an appearance used to accommodate a substrate;

a first antenna disposed on the substrate; and a metal part disposed on an external surface of the appearance and capacitive coupling to the first antenna, wherein the mobile electronic device receives or transmits signals through a first bandwidth radio frequency band by the first antenna and the metal part.

2. The mobile electronic device of claim 1, wherein the mobile electronic device further comprises a second antenna disposed on the substrate and enabling the mobile electronic device to receive or transmit signals through a second bandwidth radio frequency band by the second antenna and the metal part.

3. The mobile electronic device of claim 2, wherein the first antenna is used to receive and transmit the signals through the first bandwidth radio frequency band, the second antenna is used to receive and transmit the signals through the second bandwidth radio frequency band, and the metal part is used to receive and transmit the signals through the first bandwidth radio frequency band and the second bandwidth radio frequency band.

4. The mobile electronic device of claim 2, wherein distances respectively formed between geometric centers of the first antenna and of the second antenna projected on the external surface of the appearance and a geometric center of the metal part are maintained within a predetermined range.

5. The mobile electronic device of claim 4, wherein the geometric center of the second antenna projected on the external surface of the appearance is an intersection of a second virtual line and the external surface of the appearance, wherein the second virtual line is extended from the geometric center of the second antenna along a direction perpendicular to the substrate.

6. The mobile electronic device of claim 2, wherein the first antenna and the second antenna are respectively disposed on a first corner and a second corner on the substrate.

7. The mobile electronic device of claim 6, wherein the first corner and the second corner are adjacent to each other.

8. The mobile electronic device of claim 1, wherein a distance formed between a geometric center of the first antenna projected on the external surface of the appearance and a geometric center of the metal part is maintained within a predetermined range.

9. The mobile electronic device of claim 8, wherein the geometric center of the first antenna projected on the external surface of the appearance is an intersection of a first virtual line and the external surface of the appearance, wherein the first virtual line is extended from the geometric center of the first antenna along a direction perpendicular to the substrate.

10. The mobile electronic device of claim 1, wherein a shape of the metal part is a circle, a rectangle, a triangle or an irregular geometric shape.

11. The mobile electronic device of claim 10, wherein when the shape of the metal part is the circle, a geometric center of the metal part is a center of the circle.

12. The mobile electronic device of claim 10, wherein when the shape of the metal part is the triangle, a geometric center of the metal part is a gravity center of the triangle.

13. The mobile electronic device of claim 1, wherein the substrate is a printed circuit board.

14. The mobile electronic device of claim 1, wherein the mobile electronic device is a personal digital assistant phone, a smart phone, a satellite positioning device or a personal digital assistant.

* * * * *